US012297761B2

(12) United States Patent
Porter

(10) Patent No.: US 12,297,761 B2
(45) Date of Patent: May 13, 2025

(54) EXHAUST SYSTEM COMPONENT WITH MULTI-LAYER SUPPORT MAT

(71) Applicant: Tenneco Automotive Operating Company Inc., Northville, MI (US)

(72) Inventor: Jason Roy Porter, Spring Arbor, MI (US)

(73) Assignee: Tenneco Automotive Operating Company Inc., Northville, MI (US)

( * ) Notice: Subject to any disclaimer, the term of this patent is extended or adjusted under 35 U.S.C. 154(b) by 59 days.

(21) Appl. No.: 18/296,011

(22) Filed: Apr. 5, 2023

(65) Prior Publication Data

US 2024/0337208 A1 Oct. 10, 2024

(51) Int. Cl.
*F01N 3/28* (2006.01)

(52) U.S. Cl.
CPC ..... *F01N 3/2864* (2013.01); *F01N 2310/00* (2013.01); *F01N 2330/06* (2013.01)

(58) Field of Classification Search
CPC ..... F01N 3/2864; F01N 13/148
See application file for complete search history.

(56) References Cited

U.S. PATENT DOCUMENTS 4,782,661 A * 11/1988 Motley ..... F01N 3/2857 60/299
5,089,072 A 2/1992 Carson
6,902,710 B2 6/2005 Schnigenberg
8,388,788 B2 3/2013 Yoshimi et al.
8,632,620 B2 1/2014 Ando et al.
8,747,510 B2 6/2014 Latham et al.
9,790,836 B2 10/2017 Latham et al.
2010/0023946 A1 1/2010 McKenney
2013/0032274 A1 * 2/2013 Latham ..... B29C 63/06 156/160

FOREIGN PATENT DOCUMENTS

EP 2273084 A1 * 1/2011 ..... B01D 53/9454
KR 20220095583 A * 7/2022
WO WO-9119081 A1 12/1991

* cited by examiner

*Primary Examiner* — Jonathan R Matthias
(74) *Attorney, Agent, or Firm* — Harness, Dickey & Pierce, P.L.C.

(57) ABSTRACT

An exhaust system component comprises a housing including an inner surface having a first longitudinal axis, a core positioned within the housing and including an outer surface circumferentially extending about a second longitudinal axis offset from the first axis, and a mat positioned within the housing and compressed between the core and the housing. The mat is wrapped about an outer surface of the core more than one revolution such that a first circumferentially extending zone exists where the mat is x layers thick and a second circumferentially extending zone exists where the mat is x+1 layers thick. The second longitudinal axis is offset from the first longitudinal axis in a direction toward the first circumferentially extending zone.

20 Claims, 3 Drawing Sheets

EXHAUST SYSTEM COMPONENT WITH MULTI-LAYER SUPPORT MAT

FIELD

The present disclosure generally relates to components of an exhaust system for an internal combustion engine, and more particularly to a filter or catalytic substrate wrapped with a mat for supporting the filter or substrate within a housing.

BACKGROUND

This section provides background information related to the present disclosure which is not necessarily prior art.

Vehicles equipped with internal combustion engines emit exhaust gas containing undesirable constituents. Exhaust treatment systems are provided to remove the undesirable content and often include devices such as gasoline particulate filters or diesel particulate filters and/or one or more catalytic devices, such as a catalytic converter, diesel oxidation catalyst, or selective catalytic reduction catalyst. In such catalytic devices, it is common for a catalyst to be provided as a coating on a supporting substrate structure, such as a ceramic substrate having a monolithic structure. In particulate filters, it is common to employ a monolithic filter structure that may be catalytic or non-catalytic.

Typically, such monolithic structures may be oval or circular in cross section and are often wrapped with a layer of a support or mounting mat that is positioned between the monolithic structure and an outer housing of the exhaust device to help protect the monolithic structure from shock and vibrational forces that may be transmitted from the housing to the monolithic structure during vehicle use or component handling. The mat also functions to thermally insulate the monolithic structure from the outer housing. Typically, the support or mounting mat is made of a heat resistant and shock absorbing type material, such as a mat of glass fibers, ceramic fibers, or rock wool.

While existing exhaust system components have performed well, certain drawbacks may be addressed. For example, efforts to package components on the underside of a vehicle continue to be a challenge as the complexity of vehicles increase. It is particularly challenging when devices operating at relatively high temperatures are to be positioned in close proximity with components that typically do not exhibit high heat resistance. Care must be taken when positioning catalytic exhaust devices near seals, bearings, plastic components or other heat sensitive parts.

In addition, it has recently been discovered that undesirable pooling of injected reagent may occur in a gap between the ceramic substrate and the outer housing where the mat is positioned. It may be beneficial to locally reduce the gap in a predetermined circumferentially extending zone and align the exhaust treatment device such that the reduced gap is positioned where the pooling previously occurred.

It has also been discovered that the shape and size of the exhaust system components upstream of the filter or substrate may cause a less than completely uniform flow distribution across an inlet face of the filter or substrate. Efforts to maximize the utilization of the filter and substrate are desired.

It should also be appreciated that the cost of the mat is relatively high. Accordingly, it may be beneficial to provide an improved exhaust system component favorably addressing these issues while exhibiting reduced cost and weight.

SUMMARY

This section provides a general summary of the disclosure, and is not a comprehensive disclosure of its full scope or all of its features.

An exhaust system component comprises a housing including an inner surface having a first longitudinal axis, a core positioned within the housing and including an outer surface circumferentially extending about a second longitudinal axis offset from the first axis, and a mat positioned within the housing and compressed between the core and the housing. The mat is wrapped about an outer surface of the core more than one revolution such that a first circumferentially extending zone exists where the mat is x layers thick and a second circumferentially extending zone exists where the mat is x+1 layers thick. The second longitudinal axis is offset from the first longitudinal axis in a direction toward the first circumferentially extending zone.

In another arrangement, an exhaust system component is provided for a vehicle having a target region relative to which a feature of the exhaust system component is to be oriented. The exhaust system component includes a housing, a core and a mat positioned within the housing and compressed between the core and the housing. The mat is wrapped about an outer surface of the core more than one revolution such that a first circumferentially extending zone exists where the mat is x layers thick and a second circumferentially extending zone exists where the mat is x+1 layers thick. The second circumferentially extending zone is separate from the first circumferentially extending zone. A gap exists between the outer surface of the core and the inner surface of the housing that varies in radial size based on circumferential position. A certain radial size of the gap, such as a maximum gap or a minimum gap, provides the feature to be oriented.

Further areas of applicability will become apparent from the description provided herein. The description and specific examples in this summary are intended for purposes of illustration only and are not intended to limit the scope of the present disclosure.

BRIEF DESCRIPTION OF DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
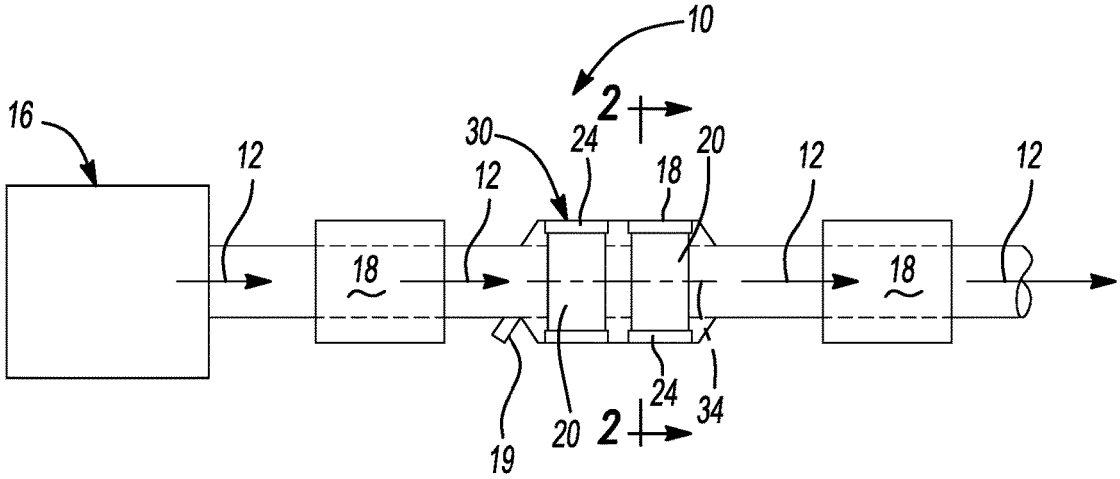
FIG. 1 is a diagrammatic representation of an exhaust gas system including an exhaust system component of the present disclosure.

An exhaust system 10 is shown in FIG. 1 operable to treat an exhaust gas 12 emitted from an internal combustion engine 16. The exhaust gas 12 of the combustion process will typically contain a variety of undesirable constituents including oxides of nitrogen (NOx) (such as nitric oxide NO and nitrogen dioxide NO2, among others), particulate matter, hydrocarbons, carbon monoxide.

Exhaust system 10 includes one or more exhaust system components 18 in receipt of exhaust gas 12 that may vary acoustic characteristics of the exhaust and/or the composition of the exhaust. Examples of exhaust system components 18 include catalytic converters, diesel oxidation catalysts, diesel particulate filters, gas particulate filters, lean NOx traps, selective catalytic reduction components, burners, manifolds, connecting pipes, mufflers, resonators, tail pipes, emission control system enclosures, insulation rings, insulated end cones, insulated end caps, insulated inlet pipes, and insulated outlet pipes. Components with the catalyst may be of the type used for heat exchangers or electrical heating. Some of the foregoing exhaust system components 18 may be entirely metallic components with a central core 20 through which the exhaust gas 12 flows. Other such components 18 may include a substrate or core 20 in the form of a ceramic monolithic structure and/or a woven metal structure through which the exhaust gas 12 flows. Exhaust system components 18 may be advantageously used, for example, in motor vehicles (diesel or gasoline), construction equipment, locomotive engine applications (diesel or gasoline), marine engine applications (diesel or gasoline), small internal combustion engines (diesel or gasoline), and stationary power generation stations (diesel or gasoline). Some exhaust systems 10 may be equipped with a reductant injector 19 for injecting reductant upstream of an exhaust system component 18 having a catalytic coating.

Figure 2:
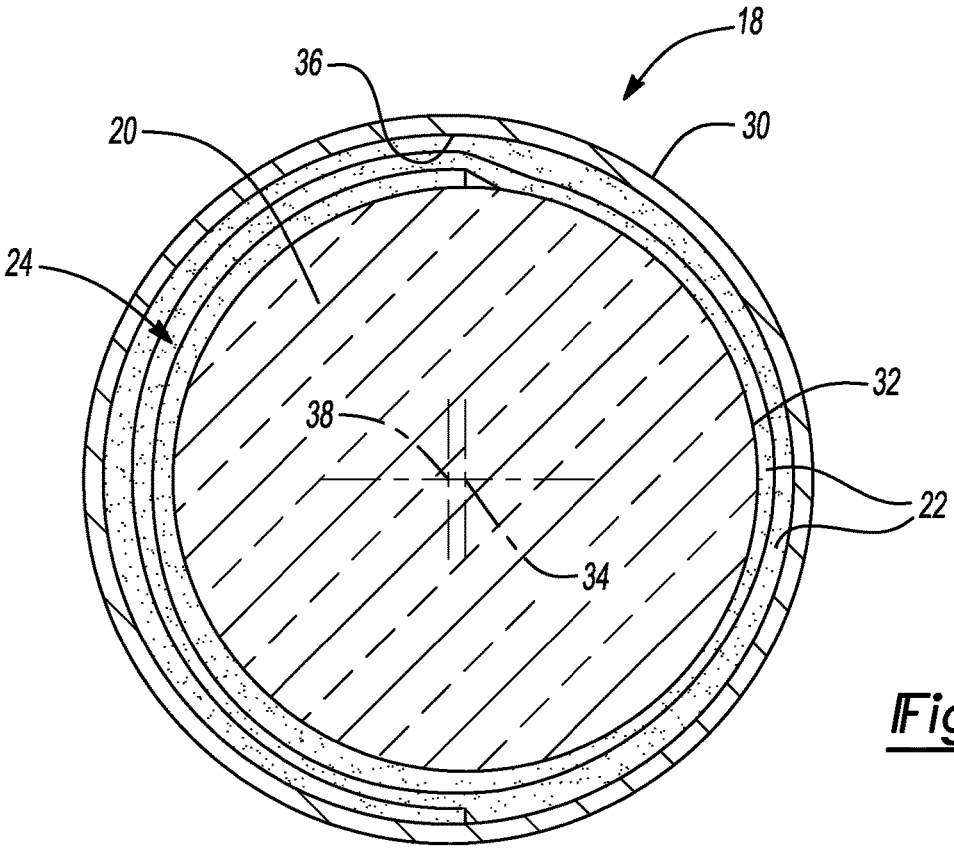
FIG. 2 is a cross-sectional view taken along line 2-2 of FIG. 1 showing the exhaust system component.

As shown in FIG. 2, the exhaust system component 18 according to the present disclosure includes core 20 and more than one layer 22 of a mounting or support mat 24 surrounding the core 20, with the support mat layers 22 being compressed inside an outer housing 30.

Advantageously, the more than one layer 22 of support mat 24 reduces the radiant heat transfer from the core 20 and exhaust gas 12 to outer housing 30. This can be beneficial for maintaining the temperature of the exhaust gas 12 and the core 20 within temperature ranges that are suitable for catalytic reactions if, for example, the core 20 includes a catalyst. The insulative properties of the support mat 24 also beneficially reduce a temperature of an outer surface of the outer housing 30.

The core 20 may be of any suitable type and construction as necessitated by the exhaust system component 18. In the embodiment illustrated in FIG. 2, the core 20 is a monolithic structure of porous ceramic carrying a catalyst coating that is suitable for the intended function of the exhaust system 10, such as, for example, a suitable oxidation catalyst or a suitable selective catalytic reduction catalyst.

The core 20 includes an outer surface 32 that circumferentially extends about a longitudinal axis 34. The outer surface 32, when viewed in cross-section through the axis 34, may be oval, elliptical, triangular, rectangular, hexagonal, or irregular in shape. In the embodiment depicted in FIG. 2, the core 20 is cylindrically shaped with the outer surface 32 being circular in cross-section.

The support mat 24 is compressed in a space defined by core outer surface 32 and an inner surface 36 of the outer housing 30. It should be appreciated that outer housing 30 defines a longitudinal axis 38 that is not co-axially aligned with the longitudinal axis 34 of core 20. The longitudinal axes 34, 38 may extend parallel to one another. The support mat 24 protects the core 20 from shock and vibrational forces that may be transmitted from the housing 30 to the core 20. The compressed support mat 24 assists core 20 in maintaining its target position and resist forces arising from exhaust gas flow pressure.

The support mat 24 may be made from any suitable material including glass fiber mat, rock wool mat, or ceramic fiber mat, such as for example, refractory ceramic fibers, mullite ceramic fibers, or other high alumina ceramic fibers.

Figure 3:
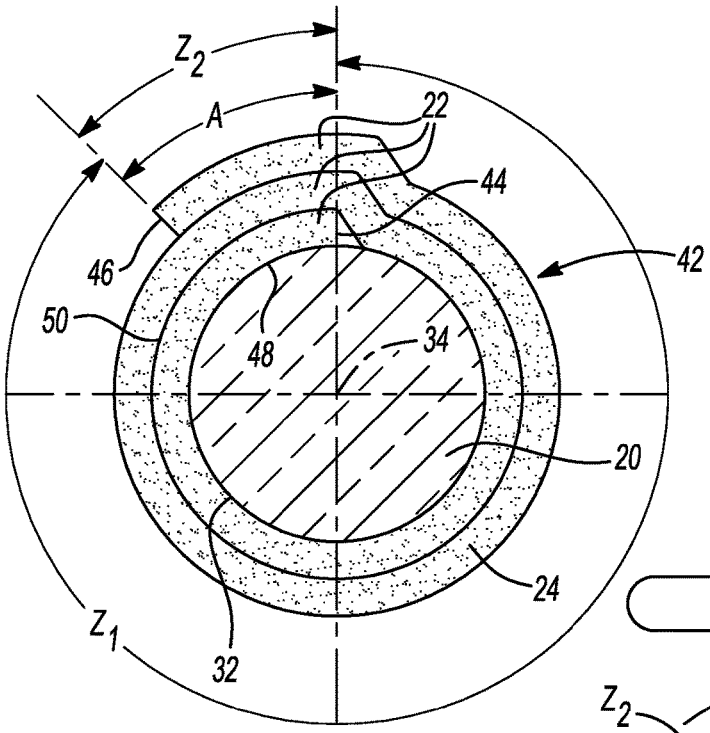
FIG. 3 is a cross-sectional view of a work-in-process subassembly of a core or substrate wrapped by a mat prior to installation within an outer housing.

FIG. 3 depicts a work-in-process subassembly 42 of support mat 24 and core 20 prior to being positioned within outer housing 30. Support mat 24 includes a first end 44 and an opposite second end 46. Support mat 24 is substantially rectangular in shape when viewed from the side, top or end. In three-dimension, support mat 24 is shaped as parallelepiped. Support mat 24 includes a first surface 48 and an opposite second surface 50. A distance between first surface 48 and second surface 50 may be considered a thickness of a layer 22 of support mat 24. A linear distance between first end 44 and second end 46 may be considered a length of support mat 24. A width of support mat 24 extends substantially the entire longitudinal extent of core 20 as measured along longitudinal axis 34.

As previously noted, it is an object of the present disclosure to minimize the cost and weight of support mat 24 required for constructing an exhaust system component 18. Several design factors are taken into consideration to optimize the performance of the exhaust system component 18. During operation, the temperature of the exhaust gas 12 and core 20 may exceed 650° C. It is desirable to limit the transfer of heat to outer housing 30 to allow exhaust system component 18 to be closely packaged relative to other components of the vehicle. As such, it may be desirable to maximize a distance between outer surface 32 of core 20 and inner surface 36 of outer housing 30. This increased spacing and the construction of support mat 24 from a suitable insulative material assists in achieving this goal.

Another design parameter relates to maintaining the as assembled position of core 20 relative to outer housing 30 during operation of a vehicle. Depending on the application, road load inputs may be significant and depending on the orientation of the loads relative to the exhaust system component 18, loads may urge core 20 to undesirably move relative to outer housing 30 in the longitudinal direction. Exhaust gas pressure also tends to urge core 20 to move relative to outer housing 30. To retain core 20 in its desired position, support mat 24 is compressed between inner surface 36 of outer housing 30 and outer surface 32 of core 20 a predetermined amount. The radial force generated by compressing support mat 24 maintains the desired position of core 20 and outer housing 30 during vehicle operation.

It has been discovered in accordance with the teachings of the present disclosure that the various design parameters may be optimized to reduce the cost and weight of exhaust system component 18. FIG. 3 depicts an work-in-process subassembly 42 illustrating a support mat 24 that extends about the circumference of core 20 in what may be considered a partial wrap design. First end 44 is circumferentially spaced apart from second end 46 by an angle A. It is contemplated that at least one complete wrap of support mat 24 is wound about core 20 and an additional portion of support mat 24 further circumferentially extends an amount based on angle A. Various embodiments are contemplated where support mat 24 may surround core 20 with one, two or more complete wraps and an additional partial wrap.

Angle A may range anywhere from 1 degree to 359 degrees. It may be preferable, however, for angle A to range from substantially 45 degrees to substantially 315 degrees to increase the likelihood of obtaining a desirable magnitude of offset between longitudinal axis 38 of outer housing 30 and longitudinal axis 34 of core 20.

The partial wrap configuration may be characterized as defining a first circumferentially extending zone $Z_1$ where x number layers 22 exist and a second circumferentially extending zone $Z_2$ where x+1 layers 22 of support mat 24 overlap one another. The variable x may equal 1 or any other positive integer.

A process of manufacturing exhaust system component 18 includes engaging first surface 48 of support mat 24 with outer surface 32 of core 20. The support mat 24 is wrapped around the core 20 until first surface 48 may no longer contact outer surface 32 of core 20 but engages second surface 50 of the portion of support mat 24 previously wrapped around the core 20. A spiral wrap arrangement is continued until the target angle A has been met. After the support mat 24 is wrapped around the core 20 with the final partial layer of support mat 24, the entire subassembly may then be inserted into the housing 30. A sizing or calibration step is next performed to suitably compress the support mat 24 to mount the core 20 and support mat 24 in the housing 30 (see FIG. 2).

It should be appreciated that the shape of the assembled support mat 24 is generally spiral but may not be precisely spiral based on the thickness of mat 24 and the partial wrap technique generating the first zone $Z_1$ and the second zone $Z_2$, as illustrated in FIG. 3. At least one benefit of implementing the partial wrap design is illustrated as follows: If angle A in FIG. 3 were 90 degrees, support mat 24 would cost and weigh 25% less than a similar mat wrapped around core 20 three complete revolutions. Support mat 24 may be constructed as a one-piece component as depicted in FIG. 3 or alternatively as more than one piece. The additional piece of support mat 24 may extend angle A and provide the extra layer in second zone $Z_2$.

Figure 4:
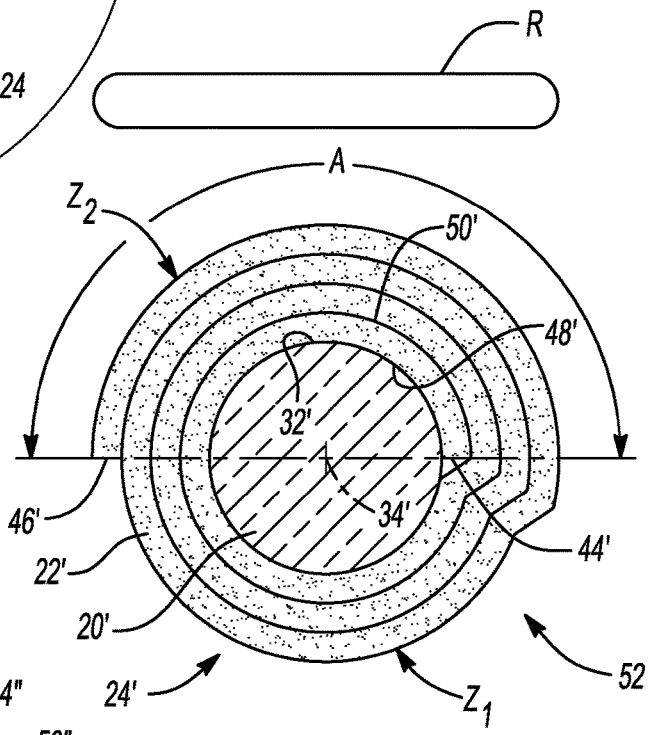
FIG. 4 is a cross-sectional view of another exemplarily embodiment of a work-in-process subassembly exhibiting a 3.5× partial wrap.

FIG. 4 depicts an alternate work-in-process subassembly 52 substantially similar to subassembly 42. Similar elements will be identified with like reference numerals including a prime suffix. Support mat 24' is wrapped about core 20' prior to positioning the components within the outer housing. FIG. 4 depicts a 3.5× wrap in which first zone $Z_1$ includes three layers 22' of support mat 24' overlapping one another for a circumferential extent of approximately 180 degrees. The second zone $Z_2$ has four layers of support mat 24' overlapping one another for a circumferential extent of approximately 180 degrees. Accordingly, angle A is approximately 180 degrees. FIG. 4 also illustrates a target region R representing a packaging volume of the vehicle that is not to be exposed to temperatures over a certain magnitude. An object of the present disclosure is achieved by orientating an exhaust system component 18 constructed using subassembly 52 in a manner such that second zone $Z_2$ is positioned proximate target region R and first zone $Z_1$ is further spaced apart from target region R than second zone $Z_2$. Based on the increased spacing between core 20' and outer housing 30' and an additional layer of support mat 24' being present at second zone $Z_2$, the temperature of outer housing 30' in second zone $Z_2$ is significantly less than the temperature of the outer housing 30' at first zone $Z_1$.

Figure 5:
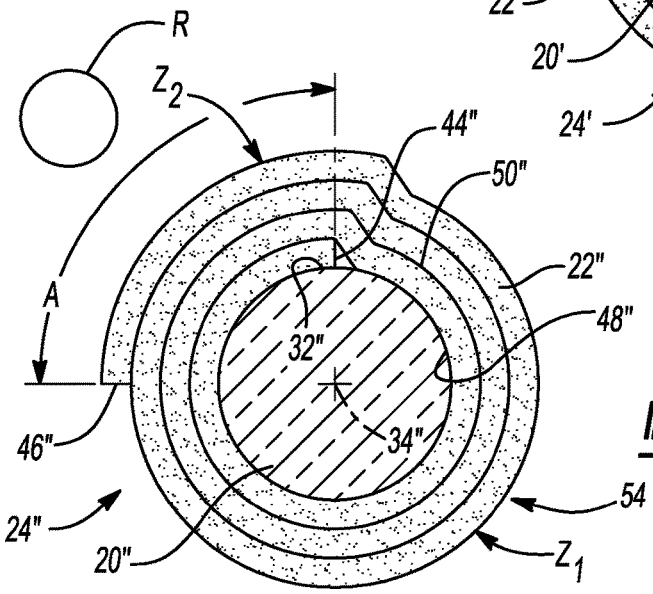
FIG. 5 depicts a cross-sectional view of another alternate embodiment work-in-process subassembly exhibiting a 3.25× partial wrap.

FIG. 5 depicts another alternate exhaust component subassembly identified at reference numeral 54. Subassembly 54 is substantially similar to subassemblies 42 and 52. As such, similar elements are identified with like numerals having a double prime suffix. Subassembly 54 includes a 3.25× wrap of support mat 24" about core 20" with angle A being approximately 90 degrees. This configuration may be useful when region R is relatively small or more concentrated such that one quarter of the circumferential extent of exhaust system component 18 may be characterized as having the second zone $Z_2$ while three quarters of the circumferential extent of exhaust system component 18 exhibits a first zone $Z_1$ having a reduced number of layers of support mat 24". The ground over which a vehicle travels may also be considered as a target region R. The cost and weight of exhaust system component 18 are optimized while achieving multiple product functions.

Figure 6:
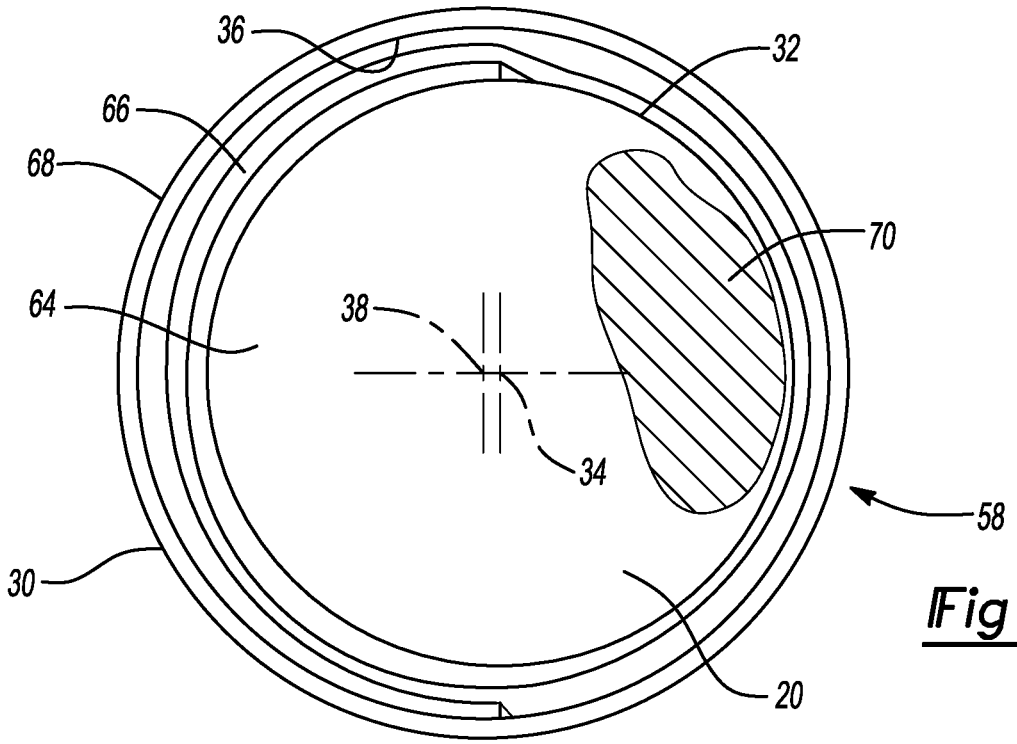
FIG. 6 is an end view of an alternate embodiment exhaust system component having a computational fluid dynamics zone indicated on an inlet face of the core or substrate.

FIG. 6 illustrates an end view of a finalized exhaust system component 58 along with a Computational Fluid Dynamics (CFD) model overlayed on an inlet face 64 of core 20. Inlet face 64 is in fluid communication with a first opening of outer housing 30 at an upstream end of the exhaust system component 18. This figure depicts a non-uniform flow of exhaust gas at the inlet face 64 based on the geometry and orientation of the exhaust system components upstream of the inlet face 64. A side face 66 of support mat 24 and an end surface 68 of outer housing 30 are also shown. The CFD model predicts that a region 70, shown in cross hatch, will receive the greatest magnitude of flow. By offsetting the longitudinal axis 34 of core 20 relative to the longitudinal axis 38 of outer housing 30 as shown, the entirety, or a vast majority of the CFD high flow region 70 will impinge the inlet face 64 of the core 20. It should be appreciated that if the core 20 were not offset or not offset in the direction depicted, the high flow region would at least partially impinge on the side face 66 of the support mat 24. The present disclosure once again optimizes the function of exhaust system component 18 while reducing its cost and weight.

Figure 7:
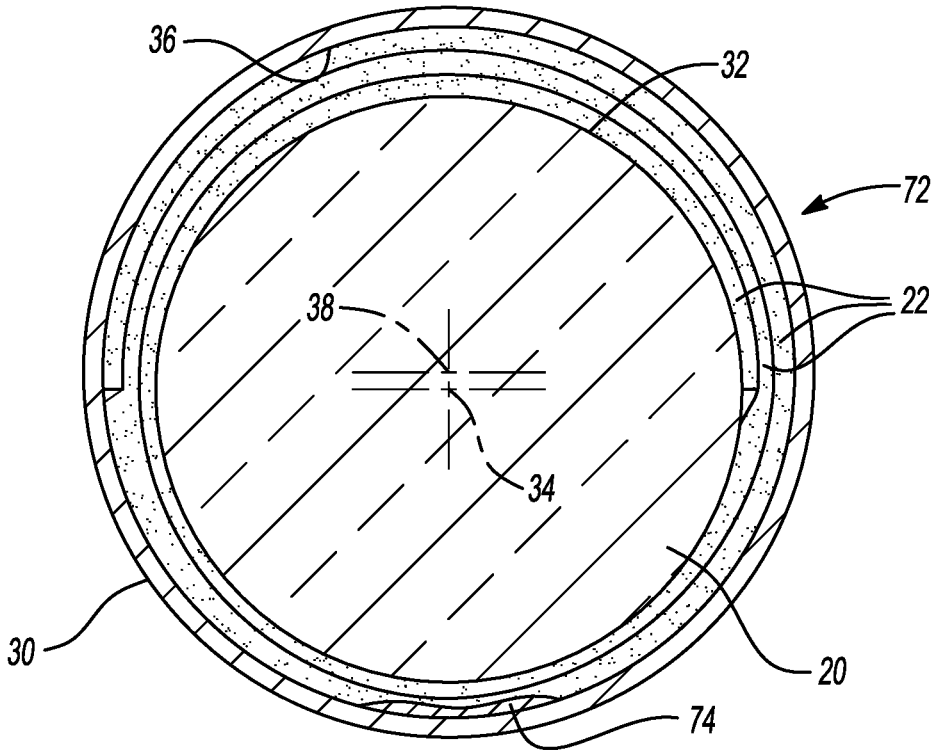
FIG. 7 is a cross-sectional view depicting an orientation of the exhaust system component minimizing a zone in which reductant pooling may occur.

FIG. 7 depicts an alternate exhaust system component 72 substantially similar to exhaust system component 58. As such, similar elements will be identified with like reference numerals. In fact, FIG. 7 represents orienting any one of the previously described exhaust system components including any one of the sub-assemblies previously described or others supported by the description in a manner such that a central portion of first zone $Z_1$ is positioned at a location 74 where injected reductant would most likely pool. It is contemplated that in most applications, this orientation will have the centralized portion of first zone $Z_1$ at the portion of the outer housing 30 closest to ground when installed in a vehicle. By orienting exhaust system component 18 in this manner, the amount of liquid reductant that may pool within support mat 24 between outer surface 32 of the core 20 and inner surface 36 of outer housing 30 is minimized. Exhaust gas flowing through core 20 will tend to evaporate liquid reductant and mix the reductant with the exhaust gas as desired.

It is contemplated that more than one exhaust system component within a given exhaust system 10 may be constructed in accordance with the teachings of the present disclosure. In particular, the core 20 of additional exhaust system components may be offset from a longitudinal centerline of additional outer housings 30 through the use of the partial wrap configurations previously described.

It may be beneficial to orient one or more of the exhaust system components relative to one another such that a maximum spacing or a minimum spacing between the outer surface 32 of the core 20 and the inner surface 36 of the outer housing 30 occurs at the same clocking angle relative to a target region R, as previously described. For example, at least two of the exhaust system components within a given exhaust system 10 may be positioned relative to one another such that a longitudinal axis 34 of the core 20 is offset in the same direction as the other exhaust system component. Stated another way, if the second zone $Z_2$ of one exhaust system component were oriented at the ten o'clock position, the second zone $Z_2$ of the other exhaust system component would also be oriented at substantially at the ten o'clock position.

In a different configuration, more than one core or substrate 20 may be fitted within a singular outer housing 30 as depicted in FIG. 1. A similar alignment of features is contemplated such that a minimum or maximum gap between the cores and the outer housing is oriented at the same angular position.

Furthermore, the foregoing discussion discloses and describes merely exemplary embodiments of the present disclosure. One skilled in the art will readily recognize from such discussion, and from the accompanying drawings and claims, that various changes, modifications and variations may be made therein without departing from the spirit and scope of the disclosure as defined in the following claims.

What is claimed is:

1. An exhaust system component comprising:

a housing including an inner surface having a first longitudinal axis;

a core positioned within the housing and including an outer surface circumferentially extending about a second longitudinal axis offset from the first axis; and a mat positioned within the housing and compressed between the outer surface of the core and the inner surface of the housing, the mat being wrapped about the outer surface of the core more than one revolution such that a first circumferentially extending zone exists where the mat is x layers thick and a second circumferentially extending zone exists where the mat is x+1 layers thick, wherein the second longitudinal axis is offset from the first longitudinal axis in a direction toward the first circumferentially extending zone and x is an integer having a magnitude of at least 2.

2. The exhaust system component of claim 1, wherein the housing includes a metal shell having a first opening at one end and a second opening at an opposite second end.

3. The exhaust system component of claim 1, wherein the core includes a first end face extending transversely to its outer surface, the first end face being in fluid communication with the first opening.

4. The exhaust system component of claim 1, wherein the circumferential extent of the second zone is substantially 180 degrees.

5. The exhaust system component of claim 1, wherein x equals 3.

6. The exhaust system component of claim 1, wherein the core includes a monolithic ceramic structure coated with a catalyst.

7. The exhaust system component of claim 1, wherein the mat is a one-piece rectangular component.

8. The exhaust system component of claim 1, wherein the mat is constructed from a compressible thermally insulative material.

9. The exhaust system component of claim 1, wherein a distance between the outer surface of the core and the inner surface of the housing varies based on circumferential position, wherein the exhaust system component is oriented such that the distance between the outer surface of the core and the inner surface of the housing is at a minimum when facing the ground.

10. The exhaust system component of claim 1, wherein a distance between the outer surface of the core and the inner surface of the housing varies based on circumferential position, wherein the exhaust system component is oriented such that the distance between the outer surface of the core and the inner surface of the housing is at a maximum when facing a region that is not to be exposed to high temperatures.

11. The exhaust system component of claim 1, wherein the first longitudinal axis extends substantially parallel to the second longitudinal axis.

12. An exhaust system component for a vehicle having a target region at which a feature of the exhaust system component is to be oriented, the exhaust system component comprising:

a housing including an inner surface;

a core positioned within the housing and including an outer surface spaced apart from the inner surface of the housing; and a mat positioned within the housing and compressed between the outer surface of the core and the inner surface of the housing, the mat being wrapped about the outer surface of the core more than one revolution such that a first circumferentially extending zone exists where the mat is x layers thick and a second circumferentially extending zone exists where the mat is x+1 layers thick, the second circumferentially extending zone being separate from the first circumferentially extending zone, wherein a gap between the outer surface of the core and the inner surface of the housing varies in radial size based on circumferential position, wherein the radial size of the gap provides the feature to be oriented and x is an integer having a magnitude of at least 2.

13. The exhaust system component of claim 12, wherein the core includes a circular cross section and the inner surface of the housing includes a circular cross section.

14. The exhaust system component of claim 12, wherein the inner surface includes a first longitudinal axis and the outer surface includes a second longitudinal axis offset from the first axis.

15. The exhaust system component of claim 14, wherein the first longitudinal axis extends substantially parallel to the second longitudinal axis.

16. The exhaust system component of claim 14, further including another core and another mat, wherein the another core includes a third longitudinal axis offset from the first longitudinal axis in the same direction as the second longitudinal axis is offset from the first longitudinal axis.

17. The exhaust system component of claim 12, wherein the mat is a one-piece rectangular component.

18. The exhaust system component of claim 12, wherein the target region defines a volume outside of the housing at which temperatures are not to exceed a predetermined magnitude.

19. The exhaust system component of claim 12, wherein the core includes a monolithic ceramic structure coated with a catalyst.

20. The exhaust system component of claim 12, wherein the exhaust system component is oriented to align a circumferential position of the exhaust system component where the gap is minimized with a location in receipt of the greatest exhaust flow at an inlet face of the core.

* * * * *